US009795256B2

(12) United States Patent
Chung

(10) Patent No.: US 9,795,256 B2
(45) Date of Patent: Oct. 24, 2017

(54) ELASTIC BAG FOAM PUMP

(71) Applicant: King Tsang Chung, Dongguan (CN)

(72) Inventor: King Tsang Chung, Dongguan (CN)

( * ) Notice: Subject to any disclaimer, the term of this patent is extended or adjusted under 35 U.S.C. 154(b) by 0 days.

(21) Appl. No.: 15/164,835

(22) Filed: May 25, 2016

(65) Prior Publication Data

US 2016/0374520 A1 Dec. 29, 2016

(30) Foreign Application Priority Data

Jun. 26, 2015 (CN) ..... 2015 1 0366563

(51) Int. Cl.

| | |
|---|---|
| ***B05B 11/00*** | (2006.01) |
| ***A47K 5/16*** | (2006.01) |
| ***B05B 7/00*** | (2006.01) |
| ***A47K 5/12*** | (2006.01) |
| *A47K 5/14* | (2006.01) |

(52) U.S. Cl.

CPC ..... *A47K 5/16* (2013.01); *A47K 5/1205* (2013.01); *B05B 7/0062* (2013.01); *B05B 11/3015* (2013.01); *B05B 11/3032* (2013.01); *B05B 11/3035* (2013.01); *B05B 11/3066* (2013.01); *B05B 11/3087* (2013.01); *B05B 11/3098* (2013.01); *A47K 5/14* (2013.01)

(58) Field of Classification Search

CPC ..... B05B 11/3087; B05B 7/0037; B05B 11/3015; B05B 11/0062; B05B 11/3032; B05B 11/3035; B05B 11/3066; B05B 11/3098; A47K 5/16; A47K 5/1205; A47K 5/14

USPC ..... 222/207, 209, 129–145.8, 321.7, 190

See application file for complete search history.

(56) References Cited

U.S. PATENT DOCUMENTS

| | | | | |
|---|---|---|---|---|
| 4,880,161 | A * | 11/1989 | Wright | B05B 11/3087 222/190 |
| 6,715,649 | B2 * | 4/2004 | Santagiuliana | B05B 11/0016 222/380 |
| 7,246,723 | B2 * | 7/2007 | Santagiuliana | B05B 11/3008 222/190 |
| 8,002,151 | B2 * | 8/2011 | Matthews | A47K 5/14 222/1 |

(Continued)

*Primary Examiner* — Paul R Durand
*Assistant Examiner* — Charles P Cheyney
(74) *Attorney, Agent, or Firm* — Wayne & Ken, LLC; Tony Hom

(57) ABSTRACT

The invention discloses an elastic bag foam pump, which comprises a bottle cover (1), an elastic bag (2), a piston rod (3), a piston (4), a liquid inlet one-way valve (6) and a gas inlet one-way valve (8), wherein the elastic bag (2) is a hollow thin-wall bag; the bag opening of the elastic bag is provided with a connection part (2.1); the connection part (2.1) is mounted on an annular wall (1.1) used for connection on the bottle cover (1) in a sealing way; the elastic bag (2) is provided with an inlet hole (1.8) through which an inlet pipe (2.4) is communicated with the bottle cover (1); the gas inlet one-way valve (8) is mounted at one side of the inlet hole (1.8); a piston rod upper end (3.1) is fixed to an upper wall connection part (2.3) of the elastic bag (2); the lower end of the piston rod (3) is provided with the piston (4); and a cylinder (1.2) is arranged in the middle of the bottle cover (1). The elastic bag foam pump has the advantages of simple structure, low cost and easy to use.

2 Claims, 3 Drawing Sheets

(56) References Cited

U.S. PATENT DOCUMENTS

| | | | | |
|---|---|---|---|---|
| 8,356,732 | B2 * | 1/2013 | van der Heijden | B05B 7/0018 222/190 |
| 8,616,414 | B2 * | 12/2013 | Ciavarella | B05B 7/0037 222/1 |
| 8,814,005 | B2 * | 8/2014 | Banks | B01F 5/0478 222/145.5 |
| 2016/0312805 | A1 * | 10/2016 | Grimm | F04F 1/18 |

* cited by examiner

ELASTIC BAG FOAM PUMP

CROSS-REFERENCE TO RELATED APPLICATIONS

This application claims priority to Chinese Patent Application No 201510366563.7 with a filing date of Jun. 26, 2015. The content of the aforementioned application, including any intervening amendments thereto, is incorporated herein by reference.

TECHNICAL FIELD

The invention relates to daily necessities, in particular to the elastic bag foam pump used for pumping foam scrubbing solution in kitchen or bathroom, or used for shaping hair, shaving foam and dyeing hair.

BACKGROUND OF THE INVENTION

The structure of existing foam pumps belongs to piston pump, with gas piston and liquid piston coaxial arranged in the bottle cover, the common products in the market are assembled by adding a guide pipe and a spray head, which are of difficult structure.

Some Chinese patents have made improvements about the foam pump aimed at its deficiencies, however, the structure is still difficult, most of them require 10-12 accessories for assembly, some small parts require precise mould, and gas piston is still arranged in the bottle cover, so it still requires bottleneck and bottle cover with large diameter to obtain enough gas amount.

Such as a foam pump in the market, the piston outside diameter of the gas piston pump is 31 mm, and the diameter of bottom outer cover is 46.6 mm. The actual effective travel is 15 mm, the total height of two overlapped piston pumps, mixed pipe and spray head is 125 mm. The foam pump of this structure cannot be arranged in common 32 mm bottleneck of 3 mL lotion bottle.

Chinese patent CN202624901 discloses a foam pump, it uses O-ring as an air cylinder piston and arranges the air cylinder piston on the bottle cover, so small bottle cover can be used to fit piston with 31 mm diameter, the bottle cover outer diameter of common bath pump is 34 mm. However, the foam pump does not have balancing hole, so that the foam pump cannot be used continually due to negative pressure in the bottle, besides, it is not so clear that how to enter air when the air cylinder breath in. More to the point, this foam pump is of difficult structure, there are 17 accessories in total, a cover, a seal ring and a guide pipe are excluded.

And such as a foam comb, two pressure tanks are adopted to start hair dye and form foam, which is of high cost and not environmental protection; and the process is to pour oxidant lotion into squeeze bottle for mixed squeeze, generate foam and coat on comb, which is inconvenient to use.

SUMMARY OF THE PRESENT INVENTION

For the purpose of overcoming the deficiencies of prior art, the present invention provides an elastic bag foam pump with simple structure, low cost and easy to use.

Purpose of the present invention is realized by adopting following technical schemes An elastic bag foam pump comprises an elastic bag air pump and a liquid piston pump, comprising a bottle cover, an elastic bag, a piston rod, a piston, and a liquid inlet one-way valve, wherein the preferred elastic bag is a hollow thin-wall bag capable of shrinkage and deformation, while the liquid piston pump is common structure. The bag opening of the elastic bag is provided with a connection element mounted on an upper wall connection part on the bottle cover in a sealing way, the elastic bag is provided with an elastic bag inlet hole, which is close to the bottle cover inlet, one side of the bottle cover inlet hole is provided with a gas inlet one-way valve; the side wall of the elastic bag is provided with a nozzle, which is close to the outlet hole of the bottle cover; a cylinder is arranged in the middle of the bottle cover, a pipe orifice is arranged on the bottom of the cylinder, the upper end of the pipe orifice is provided with the liquid inlet one-way valve, the lower end of the pipe orifice is communicated with a guide pipe, the guide pipe is used for stretching into exterior lotion bottle; the liquid piston pump comprises the piston rod and the piston, the piston rod upper end is fixed to the upper wall connection part, the lower end of the piston rod is provided with the piston, preferably, the piston is an O-ring, a cross hinge in the middle of the piston stretches into piston rod to form the outlet one-way valve, the piston rod and the piston stretch into the cylinder of the bottle cover together, an outside wall of the piston form a dynamic sealing to the cylinder; the side wall of the piston rod is provided with an outlet hole.

The upper end exterior of the cylinder on the bottle cover is provided with a storage tank surrounded by small annular wall and an overflow port communicated with a foam tank between the bottle cover outlet, a foam screen (also called filter screen) with sponge is arranged in the foam tank; a storage tank cover is arranged on the storage tank, a circular hole is arranged on the cover as the outlet channel of gas. When the elastic bag is compressed, the piston rod goes downsides, and the liquid is exhausted from the outlet one-way valve and outlet hole of the piston rod side wall, and flow into the storage tank on the bottle cover, the air entering from storage tank cover enter into foam tank with liquid through the overflow port, liquid and air are foaming on the foam screen and exhausted from elastic bag outlet. If no storage tank exists, the exhausted liquid will flow into the periphery of the bottle cover when the piston rod goes downsides, and only a small part of liquid carry out foam, so the space between the storage tank, the foam tank and the storage tank cover becomes the outlet mixed channel of liquid and air. The storage tank cover made of elastic body can be made on one side of the overflow port with single hinge, and the overflow port is a valve seat.

When the elastic bag is rebounded, the liquid inlet and outlet one-way valve and the gas inlet and outlet one-way valve start and stop automatically, air enters into the elastic bag, and piston rod goes upsides, the liquid enters hydraulic cylinder through the liquid inlet one-way valve.

When the piston goes upsides, the liquid between the gap of piston rod and cylinder wall will enter into the storage tank, calculated with the cylinder diameter of 9 mm, mean gap of 0.4 mm, and travel of 16 mm, this liquid is 0.17 g. This liquid will also enter the gap of piston rod and cylinder wall when piston rod goes downsides, so discharge liquid of liquid piston pump will not be affected.

Above structure can be changed that with the elastic bag upper end connected with the spray head, the foam pump of which the foam outlet is on the elastic bag can be obtained by adding an outlet one-way valve of liquid and air, so the construction of the outlet circular hole, storage tank and storage tank cover of piston rod lateral wall can be cancelled.

When the spray head is compressed, the elastic bag is shrunken, and the piston rod goes downsides, gas in bag and liquid in cylinder enter into the spray head through the outlet one-way valve, and carry out mixing foam through foam sponge, the foam is exhausted from the nozzle of the spray head. One end of the foam screen stretches into the nozzle, for fixing the foam screen and increasing the divided path of foam, so that foam will be more exquisite.

Chinese patent 20121015303.8 Reciprocating Elastic Diaphragm Pump proposes that metal spring is put into elastic membrane or molded by injection with elastic membrane, obviously, this structure is also applied to the structure of the elastic bag foam pump of the present invention.

Above accessory configuration is realized by reasonable design under the expectation of person ordinarily skilled in the art and market's need.

Compared with prior art, the advantages of the present invention are:

The present invention is to compress the elastic bag to exhaust and enables the piston rod to go downsides along the cylinder, then the exhausted gas with the liquid in cylinder enter into the outlet mixed channel through the piston and the piston rod, and transform to foam through the foam screen; when compressing is stopped, the compressed elastic bag provides elastic restoring force to enable piston rod to go upsides, and bring liquid into cylinder, and air enters into the elastic bag through the gas inlet one-way valve. So the present invention can pump liquid and air, combined with the foaming effect of foam device, the overall structure can be greatly simplified, and the cost is lower; moreover, the size of bottle cover is greatly reduced, so that the present invention can be conveniently mounted on common bottles with liquid, such as shampoo and detergent, which is a significant convenience to use.

DETAILED DESCRIPTION OF PREFERRED EMBODIMENTS

The present invention is further described with reference to drawings and embodiments.

Embodiment 1

Figure 1:
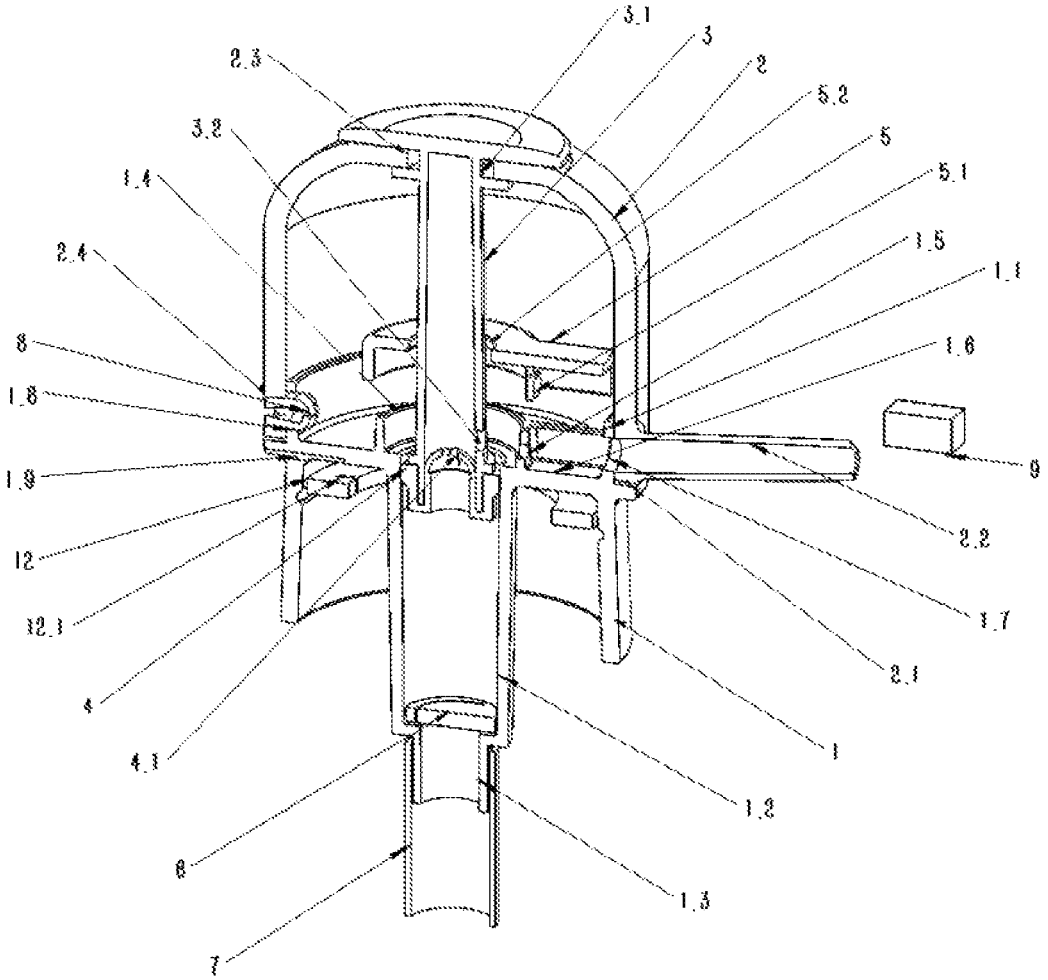
FIG. 1 is a structure diagram for elastic bag foam pump of embodiment 1 according to the present invention.

Refer to FIG. 1, an elastic bag foam pump, characterized in that it comprises a bottle cover (1) an elastic bag (2), a piston rod (3), a piston (4), a liquid inlet one-way valve (6) and a gas inlet one-way valve (8), wherein the elastic bag (2) is a hollow thin-wall bag; the bag opening of the elastic bag is provided with a connection part (2.1); the connection part (2.1) is mounted on an annular wall (1.1) used for connection on the bottle cover (1) in a sealing way; the elastic bag (2) is provided with an inlet hole (1.8) through which an inlet pipe (2A) is communicated with the bottle cover (1); the gas inlet one-way valve (8) is mounted at one side of the inlet hole (1.8); a main body of an elastic bag air pump is made up of the elastic bag and the bottle cover; a main body of a liquid piston pump is made up of the piston rod (3), the piston (4) and a cylinder of the bottle cover;

An piston upper end (3.1) is fixed to an upper wall connection part (2.3) of the elastic bag (2); the lower end of the piston rod (3) is provided with the piston (4); and a cylinder (1.2) is arranged in the middle of the bottle cover (1), a pipe orifice (1.3) is arranged on the bottom of the cylinder (1.2), the upper end of the pipe orifice (1.3) is provided with the liquid inlet one-way valve (6), the lower end of the pipe orifice (1.3) is communicated with a guide pipe (7), the guide pipe (7) is used for stretching into exterior lotion bottle; the piston rod (3) is communicated with the piston (4) and stretches into the cylinder (1.2) with the same, an outside wall of the piston form a dynamic sealing to the inner wall of the cylinder (1.2); the elastic bag foam pump is further provided with an out et mixed channel of liquid and air.

The upper end exterior of the cylinder (1.2) on the bottle cover (1) is provided with a storage tank (1.4) surrounded by small annular wall, the storage tank is communicated with a foam tank (1.6) to a bottle cover outlet (1.7), an overflow port (1.5) is arranged between the storage tank (1.4) and the foam tank (1.6), a foam screen (9) is arranged in the foam tank (1.6); a storage tank cover (5) is arranged on the storage tank (1.4) and the foam tank (1.6); the storage tank cover (5) is an elastic body, used for fixing to the outside wall of the storage tank and the foam tank in a sealing way, a first hinge (5.1) is arranged in the storage tank cover (5) and opposite to the overflow port (1.5) to form an outlet one-way valve; the storage tank cover (5) is provided with a circular hole (5.2), through which the piston rod (3) can pass, an annular space formed between the circular hole (5.2) and the piston rod (3) is an air channel of the elastic bag (2); the upper end of the piston (4) is provided with a liquid outlet one-way valve (4.1), the side wall of the piston rod (3) is provided with an outlet hole (3.2) for the flowing of liquid into the storage tank (1.4); a space between the storage tank (1.4), the foam tank (1.6) and the storage tank cover (5) is a outlet mixed channel of liquid and air, the outlet mixed channel outputs foam to a nozzle (22) of the elastic bag (2) lower side wall.

When the elastic bag (2) is compressed, the piston rod goes downsides, the liquid is mixed with the entered air through the outlet hole (3.2) of the piston rod (3) and the storage tank (1.4), and push a first hinge (5.1) away through the overflow port (1.5) to enter into the foam tank (1.6) to foam, the foam is exhausted from a bottle cover outlet (1.7) and the nozzle (2.2) of elastic bag outlet; when the compressing is stopped, the elastic bag (2) rebounds, gas pushes the gas inlet one-way valve away through an elastic bag inlet hole (2.4) and a bottle cover inlet hole (1.8) and enters into the elastic bag (2), the elastic bag (2) also brings the piston rod (3), so that the liquid is breathed in the cylinder (1.2) though the liquid inlet one-way valve (6).

The gas inlet one-way valve (8) can be located other position with elastic bag inlet hole, which can be assembled by Philips screwdriver; the assembly of this elastic bag foam pump requires 6 injection parts and 4 injection moulds.

The bottle cover (1) is provided with a seal ring (12) and a second hinge (12.1) opposite to a balancing small hole (1.9) of the bottle cover (1).

The liquid inlet one-way valve, gas inlet one-way valve, outlet one-way valve of above example can be replaced. As the common foam pump, using pressure plate and piston rod to form buckle and connection mode with sealing face, the gas inlet one-way valve can also be formed, the liquid piston and outlet one-way valve can also be assembled in a similar way. In this way, one or two sets of injection moulds will be required; however, the total parts of the elastic bag foam pump will be less than 8.

Embodiment 2

Figure 2:
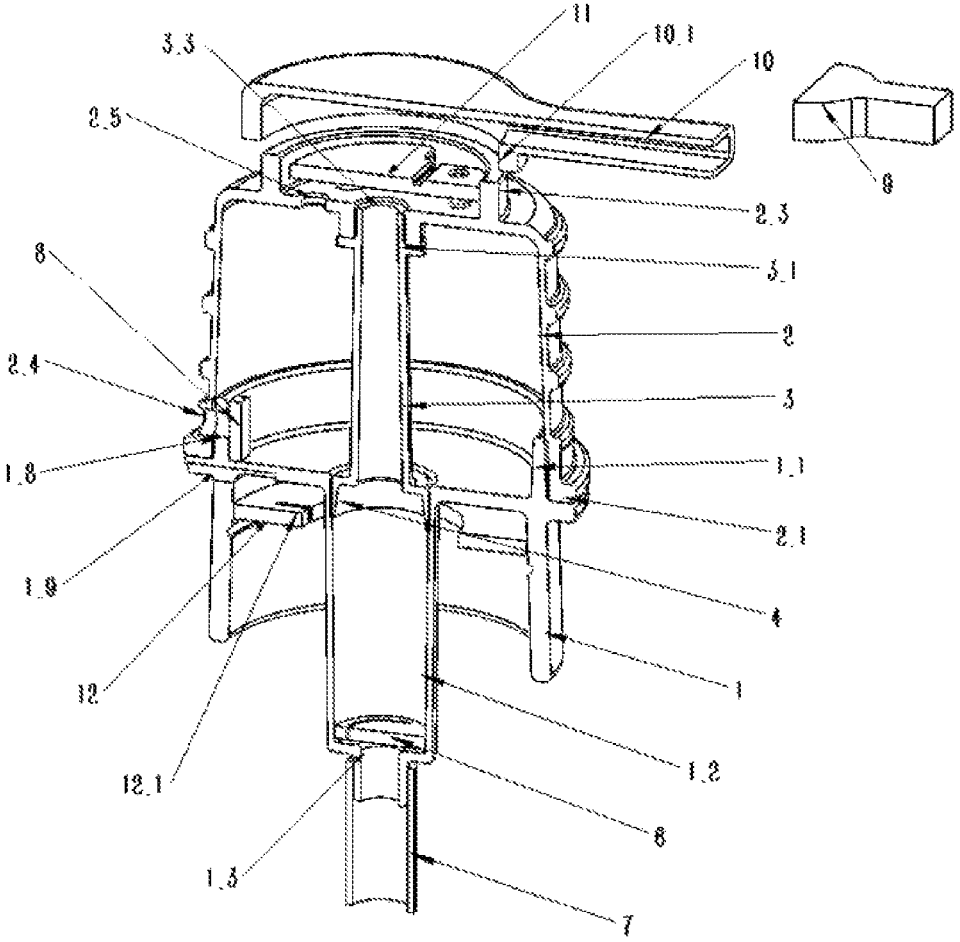
FIG. 2 is a structure diagram for elastic bag foam pump of embodiment 2 according to the present invention.

Refer to FIG. 2, an elastic bag foam pump comprises an elastic bag air pump and a liquid piston pump, comprising a bottle cover (1), an elastic bag (2), a piston rod (3), a piston (4), a spray head (10), a gas inlet one-way valve (8), a liquid inlet one-way valve (6) and a liquid outlet one-way valve (11), wherein the elastic bag (2) is a hollow thin-wall bag; the bag opening of the elastic bag is provided with a connection part (2.1); the connection part (2.1) is mounted on an annular wall (1.1) used for connection on the bottle cover (1) in a sealing way, the elastic bag is provided with an inlet hole (2.4) opposite to the bottle cover inlet hole (1.8), one side of the bottle cover inlet hole (1.8) is provided with a liquid inlet one-way valve (8).

For the liquid piston pump, the piston rod upper end (3.1) is provided with a liquid outlet (3.3), which is fixed to the upper wall connection part (2.3), a gas outlet of the elastic bag is also arranged on the upper wall connection part (2.3), one or two outlet one-way valves (11) are arranged in the upper wall connection part (2.3); the upper end of the upper wall connection part (2.3) is communicated with the spray head interface (10.1) in a sealing way, one side of the spray head (10) is provided with the foam screen (9), one end of the foam screen (9) stretches into the nozzle of the spray head (10). A cylinder (1.2) is arranged in the middle of the bottle cover, a pipe orifice (1.3) is arranged on the bottom of the cylinder, the upper end of the pipe orifice is provided with the liquid inlet one-way valve (6), the lower end of the pipe orifice is communicated with a guide pipe (7), the guide pipe (7) is used for stretching into exterior lotion bottle; the lower end of the piston rod is provided with the piston (4), the piston rod (3) and the piston (4) stretch into the cylinder (1.2) of the bottle cover together, the outside wall of the piston (4) form a dynamic sealing to inner wall of the cylinder (12).

When the spray head (10) is compressed, the elastic bag (2) is shrunken, and the piston rod (3) goes downsides, gas in elastic bag (2) and liquid in cylinder (1.2) enter into the outlet mixed channel in the spray head (10) through the outlet one-way valve (11), and carry out mixing foam through the foam screen (foam sponge), the foam is exhausted from the nozzle (2.2) of the spray head (10).

When the compressing is stopped, the elastic bag (2) rebounds, air pushes the gas inlet one-way valve away through elastic bag inlet hole (2.4) and bottle cover inlet hole (1.8) and enters into the elastic bag (2), the elastic bag (2) also brings the piston rod (3), so that the liquid is breathed in the cylinder (1.2) though the liquid inlet one-way valve (6).

The assembly of this elastic bag foam pump requires 7 injection parts and 4 injection moulds.

The elastic bag (2) is formed around the helical thick wall and thin wall.

The bottle cover (1) is provided with a seal ring (12), a second hinge (12.1) on the seal ring (12) is opposite to a balancing small hole (1.9) of the bottle cover (1).

It is obvious that if one elastic bag is assembled with two piston pumps respectively pumping different liquids of two bottles (or two flexible containers), the hair color foam bottle can be made.

The following embodiment is to explain the elastic bag foam pump has great extension space, the skilled in the art can easily design the elastic bag foam pump structured as follows.

Embodiment 3

Figure 3:
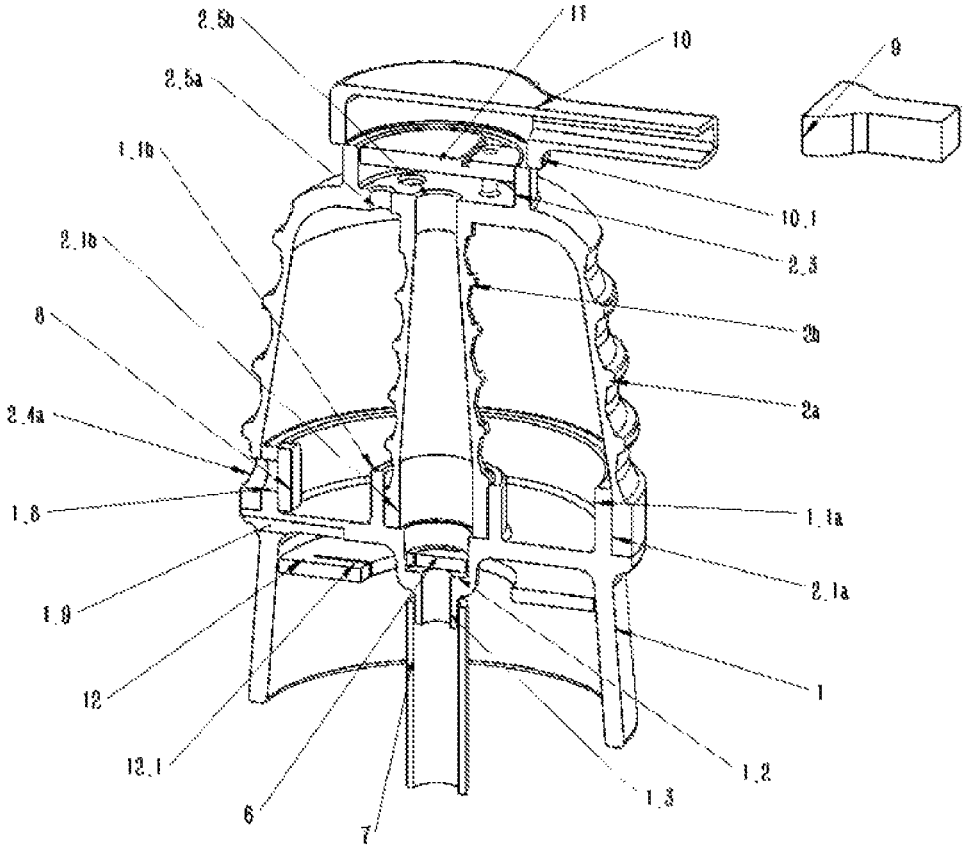
FIG. 3 is a structure diagram for elastic bag foam pump of embodiment 3 according to the present invention.

Refer to FIG. 3, the elastic bag foam pump comprises an elastic bag air pump and an elastic bag liquid pump, comprising a bottle cover (1), two elastic bodies (2*a*,2*b*) and a spray head (10); the elastic bodies (2*a*,2*b*) are the main body of the elastic bag air pump and the elastic bag liquid pump respectively, the elastic bag (2*b*) is in the elastic bag (2*a*), the upper end of which are provided with a gas outlet hole (2.5*a*) and a liquid outlet hole (2.5*b*) respectively that opens to the elastic bag connection part (2.3), an outlet one-way valve (11) is arranged in the connection part, the upper end of the connection part (2.3) on the top of the elastic bag is communicated with the interface (10.1) of the spray head (10) in a sealing way, one side of the spray head outlet is provided with a sponge foam screen (9). For the elastic bag (2*a*,2*b*), the bag openings (2.1*a*,2.1*b*) are respectively communicated with the connection part (1.1*a*,1.1*b*) of big and small annular wall of the bottle cover, the elastic bag (2*a*) is provided with an inlet hole (2.4*a*), which is opposite to the inlet hole (1.8) of the bottle cover annular wall (1.1*a*), one side of the bottle cover inlet hole (1.8) is provided with the gas inlet one-way valve (8).

The cylinder (1.2) is arranged in the middle of the bottle cover, a pipe orifice (1.3) is arranged on the bottom of the cylinder, the upper end of the pipe orifice is provided with the liquid inlet one-way valve (6), the lower end of the pipe orifice is communicated with a guide pipe, the guide pipe is used for stretching into exterior lotion bottle; an independent space of the cylinder (1.2) is formed by the elastic bag (2*b*) and connection part (1.1*b*) of small annular wall of bottle cover.

The elastic bags (2*a*, 2*b*) are formed around the helical thick wall and thin wall.

The bottle cover is provided with a seal ring 12 and a second hinge 12.1 opposite to a balancing small hole 1.9 of the bottle cover.

The assembly of this elastic bag foam pump requires 5 injection parts and 3-4 injection moulds.

Any corresponding variations and deformation based on above described technical schemes and conceptions to the skilled in the art are also considered within the protective scope of the present invention.

I claim:

1. An elastic bag foam pump, a bottle cover (1), an elastic bag (2), a piston rod (3), a piston (4), a liquid inlet one-way valve (6) and a gas inlet one-way valve (8), wherein the elastic bag (2) is a hollow thin-wall bag; the bag opening of the elastic bag is provided with a connection part (2.1); the connection part (2.1) is mounted on an annular wall (1.1) used for connection on the bottle cover (1) in a sealing way; the elastic bag (2) is provided with an inlet hole (1.8) through which an inlet pipe (2.4) is communicated with the bottle cover (1); the gas inlet one-way valve (8) is mounted at one side of the inlet hole (1.8); a main body of an elastic bag air pump is made up of the elastic bag and the bottle cover; a main body of a liquid piston pump is made up of the piston rod (3), the piston (4) and a cylinder of the bottle cover;

a piston rod upper end (3.1) is fixed to an upper wall connection part (2.3) of the elastic bag (2); the lower end of the piston rod (3) is provided with the piston (4);

and a cylinder (1.2) is arranged in the middle of the bottle cover (1), a pipe orifice (1.3) is arranged on the bottom of the cylinder (1.2), the upper end of the pipe orifice (1.3) is provided with the liquid inlet one-way valve (6), the lower end of the pipe orifice (1.3) is communicated with a guide pipe (7); the piston rod (3) is communicated with the piston (4) and stretches into the cylinder (1.2) with the same, an outside wall of the piston form a dynamic sealing to the inner wall of the cylinder (1.2), the elastic bag foam pump is further provided with an outlet mixed channel of liquid and air;

the upper end exterior of the cylinder (1.2) on the bottle cover (1) is provided with a storage tank (1.4) surrounded by small annular wall, the storage tank is communicated with a foam tank (1.6) to a bottle cover outlet (1.7), an overflow port (1.5) is arranged between the storage tank (1.4) and the foam tank (1.6), a foam screen (9) is arranged in the foam tank (1.6); a storage tank cover (5) is arranged on the storage tank (1.4) and the foam tank (1.6); the storage tank cover (5) is an elastic body, used for fixing to the annular wall of the storage tank and an outside wall of the foam tank in a sealing way, a first hinge (5.1) is arranged on the storage tank cover (5) and opposite to the overflow port (1.5) to form an outlet one-way valve; the storage tank cover (5) is provided with a circular hole (5.2), through which the piston rod (3) can pass, an annular space formed between the circular hole (5.2) and the piston rod (3) is an air channel of the elastic bag (2); the upper end of the piston (4) is provided with a liquid outlet one-way valve (4.1), the side wall of the piston rod (3) is provided with an outlet hole (3.2) for the flowing of liquid into the storage tank (1.4); a space defined between the storage tank (1.4), the foam tank (1.6) and the storage tank cover (5) is an outlet mixed channel of liquid and air, the outlet mixed channel of liquid and air, the outlet mixed channel outputs foam to a nozzle (2.2) of the elastic bag (2) lower side wall.

2. The elastic bag foam pump according to claim 1, characterized in that the bottle cover (1) is provided with a seal ring (12), a second hinge (12.1) on the seal ring (12) is opposite to a balancing small hole (1.9) of the bottle cover (1).

* * * * *